US008096253B1

(12) United States Patent
Ruffa

(10) Patent No.: US 8,096,253 B1
(45) Date of Patent: Jan. 17, 2012

(54) CABLE FAIRING ATTACHMENT

(75) Inventor: Anthony A. Ruffa, Hope Valley, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 212 days.

(21) Appl. No.: 12/701,007

(22) Filed: Feb. 5, 2010

(51) Int. Cl.
*F15D 1/10* (2006.01)

(52) U.S. Cl. ..... 114/243

(58) Field of Classification Search ..... 114/243
See application file for complete search history.

(56) References Cited

U.S. PATENT DOCUMENTS

| | | | | |
|---|---|---|---|---|
| 3,180,051 | A * | 4/1965 | Freeman | 43/43.12 |
| 3,707,836 | A | 1/1973 | Lovett | |
| 3,712,261 | A | 1/1973 | McLelland et al. | |
| 3,859,949 | A * | 1/1975 | Toussaint et al. | 114/243 |
| 4,033,279 | A | 7/1977 | Stiles | |
| 4,567,841 | A | 2/1986 | Hale | |
| 4,700,651 | A | 10/1987 | Hale | |
| 4,829,929 | A | 5/1989 | Kerfoot | |
| 5,335,620 | A | 8/1994 | Small | |
| 5,456,199 | A | 10/1995 | Kernkamp | |
| 6,030,229 | A | 2/2000 | Tsutsui | |
| 6,189,475 | B1 | 2/2001 | Coakley | |
| 6,988,854 | B2 | 1/2006 | Porter | |
| 7,344,380 | B2 | 3/2008 | Neidlein et al. | |

* cited by examiner

*Primary Examiner* — Stephen Avila
(74) *Attorney, Agent, or Firm* — James M. Kasischke; Michael P. Stanley; Jean-Paul A. Nasser

(57) ABSTRACT

Systems and methods for automatically applying fairings to a cable as the cable is deployed from a winch are provided. Each fairing has two halves, with each half having a recess, or groove, to accommodate the cable. Like halves are connected together and the two halves are stored on separate spools. Counter-rotating wheels adjacent to and on opposite sides of the cable serve to feed the fairing halves from the spools to the cable as the cable is deployed. As the fairing halves approach the cable, magnets in the fairing halves are attract each other and bring the two halves together around the cable and firmly hold the two halves together. When the cable is retrieved, guides align the fairings such that a wedge can pry the two halves apart. The halves can be picked up by the wheels and fed back onto the spools.

14 Claims, 3 Drawing Sheets

CABLE FAIRING ATTACHMENT

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

The present invention relates to cable fairings, and more specifically to systems and methods for automatically applying fairings to a cable as it is deployed from a winch.

(2) Description of the Prior Art

Unfaired cable has a normal drag coefficient of approximately 1.5, compared to about 0.2 for a cable with hard fairings. When an unfaired cable is deployed from a winch into a fluid medium, this increased drag significantly increases the amount of cable required to achieve a certain depth.

Despite this reality of operation, cables are often not faired because faired cables require increased winch sizes compared to non-faired cables and faired cables also increase the complexity of handling the cable. Conventional winches can typically only accommodate one layer of faired cable. Some specialized winches have been designed to accommodate two (or more) layers of faired cable by separating them with annular steel shells. However, these designs are complex and expensive.

Several fairing designs allow multiple layers of cable to be wound on a single winch. Ribbon fairing and hairy fairing are commonly used. These fairings include streamers (ribbons) or short pliant hairs attached to the cable.

Another type of fairing, known as zipper fairing, consists essentially of a sheet of reinforced polyethylene (or similar material) that is wrapped around the cable and then sealed (zipped) to itself at two free ends. These designs do reduce drag, but not nearly as much as hard fairings. Furthermore, these designs tend to be destroyed by handling systems.

Another major issue affecting automated attachment of hard fairings is the alignment of the fairing during attachment. Hard fairings are typically held together with screws. Some hard fairings have internal fasteners that snap together as the two fairing pieces are attached to the cable. Automating screw attachments onboard a ship would require a complicated attachment system. Additionally, potential misalignment problems preclude onboard automation of either of these designs.

What are therefore needed are systems and methods for automatically applying hard fairings to a cable as the cable is deployed from a winch.

SUMMARY OF THE INVENTION

It is therefore a general purpose and object of the present invention to provide systems and methods for automatically applying fairings to a cable as the cable is deployed from a winch.

To attain the object described, the fairings are fabricated in two halves, with each half having a recess to accommodate the cable. Like halves are chained together and the two halves are stored on separate spools. Counter-rotating wheels adjacent to and on opposite sides of the cable serve to feed the fairing halves from the spools to the cable as the cable is deployed.

As fairing halves approach the cable, magnets in the fairing halves are attracted to each other and bring the two halves of the fairing together around the cable. In a variation of the attraction properties, a magnet in one of the fairing halves is replaced with iron, steel or other material that is strongly attracted to magnets. The magnetic attraction helps to correctly align the fairings. When the cable is retrieved, guides align the fairings such that a wedge can pry the two halves apart. The halves can be picked up by the wheels and fed back onto the spools.

In one embodiment, a system for applying fairings to a cable includes a first spool of first fairing halves and a second spool of fairing halves complimentary to the first fairing halves. The system includes first and second wheels whose rotations feed the first and complimentary fairing halves from the respective spools to respective locations proximate to and on opposite sides of the cable. Each fairing half has at least one magnet disposed therein, such that magnetic attraction between the magnets results in clamping the fairing halves about the cable to form a full fairing.

In one embodiment, complimentary grooves in the fairing halves accommodate the cable therein. The surfaces of the grooves can be textured for gripping the cable. In a further embodiment, connectors are attached between each of the first fairing halves and between each of the complimentary fairing halves. In a still further embodiment, fin guides can be affixed to the first and second wheels along their respective perimeters. The fin guides align the fairing halves for clamping about the cable.

In one embodiment, the connectors can be fabricated of a flexible chord. Still further, the connectors can be continuous through a plurality of fairing halves.

In one embodiment, one or both of the fairing halves has an indent extending along an edge transverse to the cable when the fairing halves clamp about the cable. A wedge is disposed to engage the indent so as to separate the fairing halves from the cable as the fairing halves move over the wedge. In one embodiment, a fairing guide adjacent the cable angularly aligns a plurality of the full fairings along the cable.

In one embodiment, a fairing system includes complimentary first and second fairing halves. Each fairing half includes one or more magnets and the halves include complimentary grooves. Magnetic attraction between the magnets clamps the fairing halves about a cable to form a full fairing, with the grooves accommodating the cable therein.

In one embodiment, connectors attach a plurality of first fairing halves to each other to form a chain. Similarly, connectors attach a plurality of second fairing halves to each other to form another chain. The connectors can be fabricated of flexible chord. Further, the connectors can be continuous through a plurality of fairing halves.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE INVENTION

Figure 1:
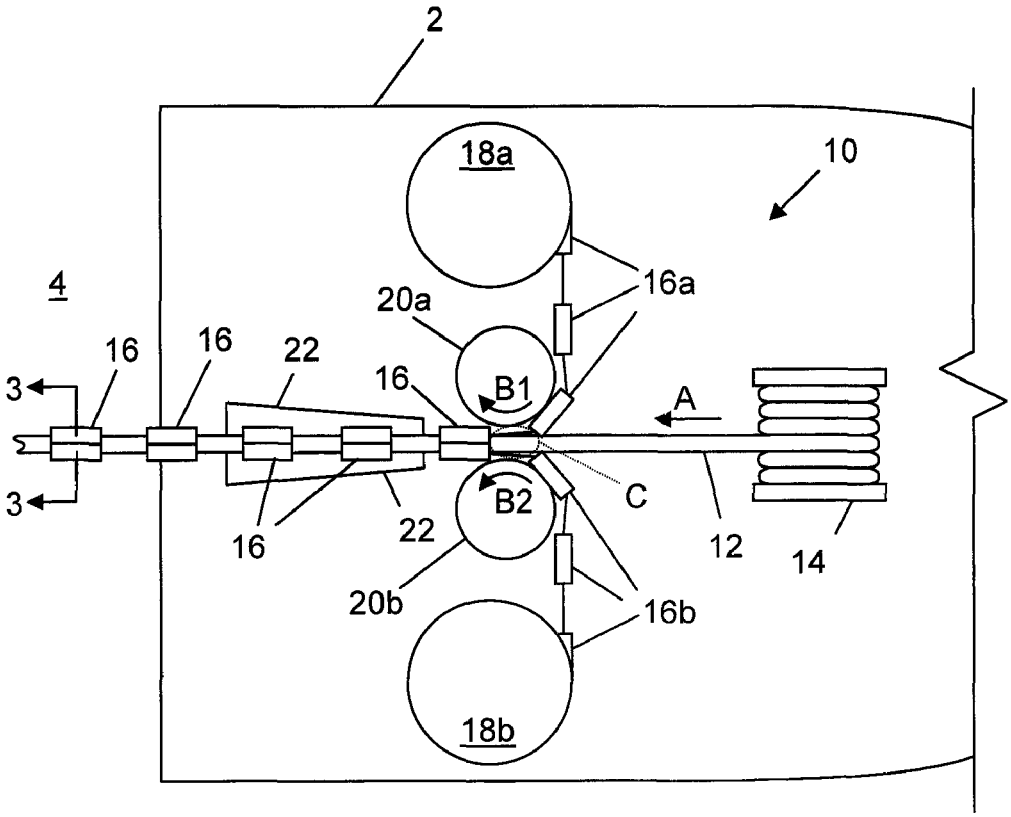
FIG. 1 depicts a top view of a system of the present invention in which the system is capable of automatically applying fairings to a cable.

Referring to FIG. 1, there is shown a top view of system 10 of the present invention. In the figure, the system 10 deploys cable 12 from cable reel 14 and feeds the cable from a ship 2 into a fluid medium 4—in the direction indicated by arrow A. In addition to deploying the cable 12, the system 10 automatically attaches fairings 16 onto cable 12.

The fairings 16 are fabricated in two complimentary halves, 16*a* and 16*b*, which are stored separately on respective spools 18*a* and 18*b*. As will be explained in further detail hereinafter, the halves 16*a* are chained together on the spool 18*a* and the halves 16*b* are chained together on the spool 18*b*.

The chained halves 16*a* and 16*b* are fed onto respective wheels 20*a* and 20*b*, which are near to, and on opposite sides of, the cable 12. As the cable 12 is fed through the system 10, the wheels 20*a* and 20*b* counter-rotate (as indicated by arrows B1 and B2) and hence feed the fairing halves 16*a* and 16*b* towards the cable. As the fairing halves 16*a* and 16*b* rotate with the respective wheels 20*a* and 20*b*, they are brought adjacent the cable 12 (designated in phantom generally as area C in FIG. 1).

As the fairing halves 16*a* and 16*b* near each other on opposite sides of the cable 12, magnetic attraction between fairing halves start to pull the fairing halves together and free them from the respective wheels 20*a* and 20*b*. As the fairing halves 16*a* and 16*b* become free of the respective wheels 20*a* and 20*b*, the fairing halves attach to each other about the cable 12 to form the full fairings 16.

The system 10 can also be used in retrieving the cable 12 from the medium 4 back onto the ship 2, with the fairing halves 16*a* and 16*b* returned onto the respective spools 18*a* and 18*b*. In retrieving the cable 12, the direction of arrows A, B1 and B2 in FIG. 1 would be reversed. Guides 22 angularly align the fairings 16 for retrieval onto the wheels 20*a* and 20*b*.

Figure 2:
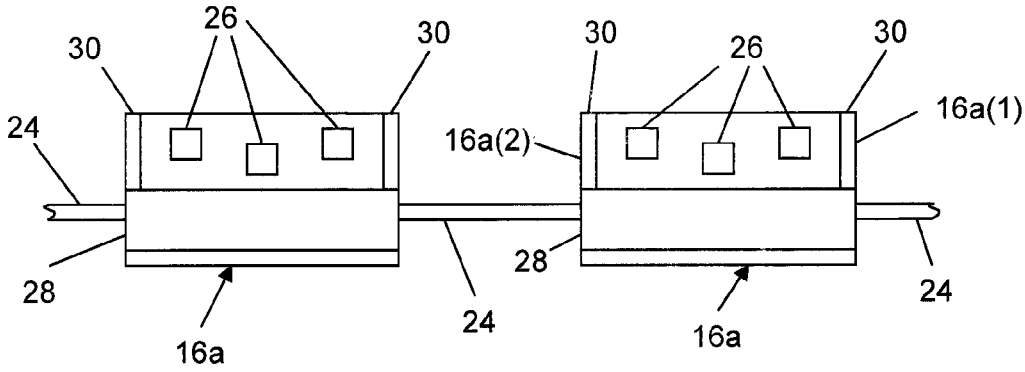
FIG. 2 depicts a partial side view of a chain of fairing halves.

Referring now to FIG. 2, there is shown a side view of chained fairing halves 16*a*. As the fairing halves 16*a* and 16*b* are complimentary, those of ordinary skill in the art will recognize that FIG. 2 may also represent the fairing halves 16*b* and that the following discussion applies equally to the fairing halves 16*b*. The chained fairing halves 16*a* are linked by a flexible connector 24.

As is known in the art, anti-stacking rings (not shown) can be fitted to a cable to limit the movement of fairings along the cable, especially as the diameter becomes smaller when the cable is under tension due to the Poisson effect. The length of the connector 24 and the location of the connector relative to the cable 12 can be such as to accommodate such stacking rings. Preferably, but not for limitation, the connector 24 may be a rope, cable, cord, or chain of material, such as Kevlar®, steel, or high-strength polymer, that has sufficient strength to withstand the handling, deployment and hydrodynamic forces that the fairing halves 16*a* are subjected to.

Depending on the chosen fabrication technique, but not for limitation, the connector 24 may be continuous through the fairing halves 16*a* (e.g., the fairing halves 16*a* may be cast about connector). Alternately, or in combination, individual fairing halves 16*a* can be linked by connectors 24 after fabrication. For example, the fairing halves 16*a* may be fabricated with a loop to which connectors 24 are attached, allowing for varying the length between the chained fairing halves 16*a*.

To provide the magnetic attraction previously described with respect to FIG. 1, one or more magnets 26 are recessed into the fairings halves 16*a*. The number and location of the magnets 26 will depend on the strength of magnets, the size of the cable 12 and the specific design of the fairing halves 16*a*.

The groove 28 accommodates the cable 12 when the fairing halves 16*a* and 16*b* are brought together about the cable, as described previously with respect to FIG. 1. The surface of the groove 28 may be dimpled or otherwise textured to minimize slippage of the cable 12 within the fairings 16.

For retrieval purposes, as will be explained in further detail hereinafter, first edge 16*a*(1) of the fairing halves 16*a* has chamfer 30 extending the length thereof. To maintain the symmetry between the fairing halves 16*a* and 16*b*, but not for limitation, the chamfer 30 also extends along opposite edge 16*a*(2) of the fairing halves 16*a*. For clarity of illustration, edges 16*a*(1) and 16*a*(2) are designated only on one of the fairing halves 16*a* in FIG. 2.

Figure 3:
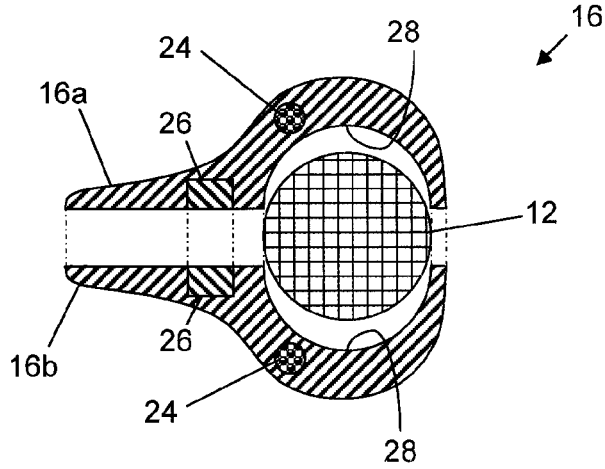
FIG. 3 depicts a cross-sectional view of a fairing attached to a cable.

Referring also to FIG. 3, there is shown a schematic cross-sectional view of the fairing 16 taken at reference line 3-3 of FIG. 1. The fairing halves 16*a* and 16*b* are disposed about the cable 12 to form full fairing 16. For clarity of illustration but not limitation, the fairing halves 16*a* and 16*b* are shown slightly separated. In actual deployment, the fairing halves 16*a* and 16*b* would abut each other and the cable 12. The fairing halves 16*a* and 16*b* can be fabricated such that the fairing 16 has a shape known to those of skill in the art to reduce drag. The mutual attraction of the magnets 26 holds the fairing halves 16*a* and 16*b* together while the cable 12 is held within the complimentary grooves 28.

Figure 4:
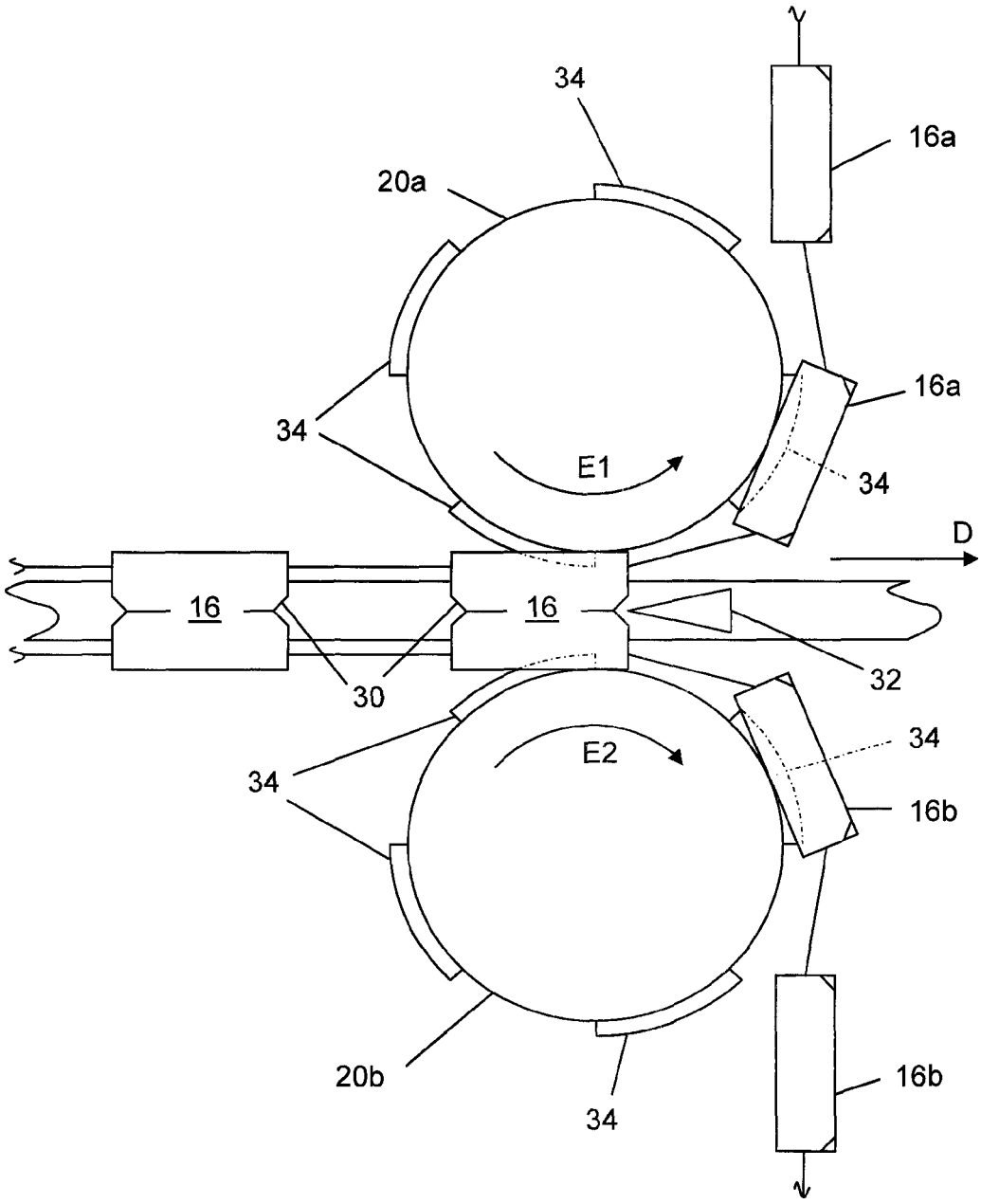
FIG. 4 depicts a top view of fairings being retrieved.

Referring now to FIG. 4, there is shown a top view of the fairings 16 being retrieved. As the fairing 16 approaches the wheels 20*a* and 20*b* in the direction of arrow D, wedge 32 inserts itself in the chamfers 30 (only two of which are designated—for clarity). Continued movement of the fairing 16 in the direction of arrow D results in the wedge 32 splitting the fairing into the fairing halves 16*a* and 16*b*. Fins 34 guide the fairing halves 16*a* and 16*b* onto the respective wheels 20*a* and 20*b*.—which counter-rotate in the directions indicated by arrows E1 and E2. In turn, the wheels 20*a* and 20*b* feed the fairing halves 16*a* and 16*b* onto the respective spools 18*a* and 18*b* (shown in FIG. 1). When retrieval is complete, the wedge 32 can be removed such that deployment of the cable 12 can proceed.

What has thus been described is a system that automatically applies fairings to a cable as the cable is deployed from a winch. The fairings are fabricated in two complimentary halves. A recess, or groove, in each half accommodates the cable. One set of halves are chained together and are stored on a first spool. A complimentary set of halves is also chained together and stored on a separate spool.

Counter-rotating wheels adjacent to and on opposite sides of the cable serve to feed respective fairing halves from the spools towards the cable. As the wheels rotate, the fairing halves approach the cable. Magnets in the complimentary fairing halves are attracted to each other and bring the two halves of the fairing together about the cable. The cable is held firmly in place within the grooves of the respective halves. When the cable is retrieved, guides align the fairings such that a wedge can pry the two halves apart. The halves can be picked up by the wheels and fed back onto the spools.

The system provides the advantages of hard fairings, in terms of drag and robustness, while lessening the alignment tolerances normally required for automatic application of hard fairings to a cable. The attraction of the magnets in the fairing halves tends to self-align the halves as they are brought together about the cable. In addition, the weight of the magnets would tend to lessen the length of cable required to achieve a certain depth.

Obviously many modifications and variations of the present invention may become apparent in light of the above teachings. For example, the wheels 20*a* and 20*b* may include depressions thereon that the respective fairing halves 16*a* and 16*b* may fit into. In addition to aligning the fairing halves, fins 34 (or a combination of fins 34 and depressions) can serve to appropriately separate the fairing halves from one another. As further examples, the chamfer 30 can have a rounded profile, or can simply be an indent that the wedge 32 can engage. Also, the magnets 26 can have an anti-corrosion coating.

In light of the above, it is therefore understood that within the scope of the appended claims, the invention may be practiced otherwise than as specifically described.

What is claimed is:

1. A system for applying fairings to a cable, said system comprising:

a first spool of first fairing halves;

a first wheel, rotation of said first wheel capable of feeding said first fairing halves from said first spool to a first location proximate to said cable;

a second spool of second fairing halves complimentary to mate to said first fairing halves;

a second wheel, rotation of said second wheel feeding said second fairing halves from said second spool to a second location proximate to said cable, said second location being diametrically opposed to said first location with respect to said cable; and at least one magnet in each of said first and second fairing halves, a magnetic attraction between said magnets in said first and second fairing halves capable of clamping said first and second fairing halves about said cable to form a full fairing.

2. A system according to claim 1, said system further comprising complimentary grooves in said first and second fairing halves, said grooves accommodating said cable therein.

3. The system according to claim 1, wherein said at least one magnet is in said first fairing half and a material attracted to magnets is in said second fairing half.

4. A system according to claim 2, said system further comprising:

a first connector attached between each of said first fairing halves; and a second connector attached between each of said second fairing halves.

5. A system according to claim 2, said system further comprising fin guides affixed to said first and second wheels along respective perimeters thereof, said fin guides aligning said first and second fairing halves for clamping about said cable.

6. A system according to claim 2, said system wherein surfaces of said grooves are textured.

7. A system according to claim 1, said system further comprising:

a first connector attached between each of said first fairing halves; and a second connector attached between each of said second fairing halves.

8. A system according to claim 7, said system further comprising fin guides affixed to said first and second wheels along respective perimeters thereof, said fin guides aligning said first and second fairing halves for clamping about said cable.

9. A system according to claim 7, wherein said first and second connectors each comprise a flexible chord.

10. A system according to claim 9, wherein said first and second connectors are continuous through a plurality of said first and second fairing halves, respectively.

11. A system according to claim 1, said system further comprising fin guides affixed to said first and second wheels along respective perimeters thereof, said fin guides aligning said first and second fairing halves for clamping about said cable.

12. A system according to claim 1, said system further comprising:

an indent extending along an edge of at least one of said first and second fairing halves, said edge having a transverse relationship with said cable when said first and second fairing halves clamp about said cable; and a wedge disposed to engage said indent, said wedge capable of separating said first and second fairing halves from said cable as said first and second fairing halves move over said wedge.

13. A system according to claim 12, said system further comprising a fairing guide adjacent said cable, said fairing guide angularly aligning a plurality of said full fairings.

14. A system according to claim 1, said system further comprising a fairing guide adjacent said cable, said fairing guide angularly aligning a plurality of said full fairings.

* * * * *